US006937001B2

(12) United States Patent
Ueda

(10) Patent No.: US 6,937,001 B2
(45) Date of Patent: Aug. 30, 2005

(54) CIRCUIT FOR GENERATING A REFERENCE VOLTAGE HAVING LOW TEMPERATURE DEPENDENCY

(75) Inventor: Yoshinori Ueda, Hyogo (JP)

(73) Assignee: Ricoh Company, Ltd. (JP)

( * ) Notice: Subject to any disclaimer, the term of this patent is extended or adjusted under 35 U.S.C. 154(b) by 0 days.

(21) Appl. No.: 10/492,418

(22) PCT Filed: Feb. 26, 2003

(86) PCT No.: PCT/JP03/02152

§ 371 (c)(1),
(2), (4) Date: Apr. 12, 2004

(87) PCT Pub. No.: WO03/073508

PCT Pub. Date: Sep. 4, 2003

(65) Prior Publication Data

US 2005/0040803 A1 Feb. 24, 2005

(30) Foreign Application Priority Data

Feb. 27, 2002 (JP) ..... 2002-051223

(51) Int. Cl.[7] ..... G05F 3/16
(52) U.S. Cl. ..... 323/313; 323/281; 323/907
(58) Field of Search ..... 323/281, 313, 323/314, 315, 316, 317, 907

(56) References Cited

U.S. PATENT DOCUMENTS 4,250,445 A 2/1981 Brokaw
4,622,512 A * 11/1986 Brokaw ..... 323/313
5,521,489 A * 5/1996 Fukami ..... 323/313
5,625,278 A * 4/1997 Thiel et al. ..... 323/280
6,218,822 B1 * 4/2001 MacQuigg ..... 323/313
6,323,628 B1 * 11/2001 Park ..... 323/281
6,504,350 B2 * 1/2003 Leonowich ..... 323/281

FOREIGN PATENT DOCUMENTS

| | | |
|---|---|---|
| EP | 170391 | 2/1986 |
| EP | 0698841 | 2/1996 |
| JP | 11-121694 | 4/1999 |
| JP | 2000-235423 | 8/2000 |

OTHER PUBLICATIONS

Gray, P. and Meyer, R., "Analysis and Design of Analog Integrated Circuits", Dec. 1977, John Wiley & Sons, pp. 288 293.

* cited by examiner

*Primary Examiner*—Jeffrey Sterrett
(74) *Attorney, Agent, or Firm*—Dickstein Shapiro Morin & Oshinsky LLP

(57) ABSTRACT

A circuit for generating a reference voltage includes a bandgap reference circuit that exhibits low temperature dependency of the output reference voltage. Since temperature dependencies of resistances thereof are appropriately controlled so that the temperature dependency of a load current flowing through divisional resistances is eliminated, it is possible to prevent the linearity of temperature dependency of the forward direction voltages of diodes from degrading. Accordingly, the temperature dependency of output is reduced.

21 Claims, 5 Drawing Sheets

CIRCUIT FOR GENERATING A REFERENCE VOLTAGE HAVING LOW TEMPERATURE DEPENDENCY

TECHNICAL FIELD

The present invention generally relates to a circuit for generating a reference voltage, and particularly, to a stand-alone circuit and a circuit embedded in a semiconductor apparatus for generating a reference voltage, a method of manufacturing the circuit, and a power supply apparatus using the circuit. The power supply apparatus is especially suitable to a compact apparatus such as a mobile phone.

BACKGROUND ART

A bandgap reference circuit using bipolar transistors is widely known as conventional art. The basic configuration of the circuit and its operational principle is published in, for example, Japanese Laid-open Patent Application No. 11-121694 and a book "Analysis and Design of Analog Integrated Circuits", P. R. Gray, et al., 1977, John Wiley & Sons.

The principle will be described below.

FIG. 8 is a circuit diagram showing a conventional circuit for generating a reference voltage.

The bandgap reference circuit includes the following: an operational amp 1; a third resistance R6 and a bipolar transistor Q3 connected in series between the output terminal of the operational amp 1 and the ground; a second resistance R5, a first resistance R4, and a bipolar transistor Q4 connected in series between the output terminal of the operational amp 1 and the ground. The collector and the base of each bipolar transistor Q3 and Q4 are electrically connected to each other. The bipolar transistors Q3 and Q4 are connected as diodes.

The non-inverted input terminal (+) of the operational amp 1 is connected to a connection point 13 between the third resistance R6 and the transistor Q3. The inverted input terminal (−) of the operational amp 1 is connected to a connection point 15 between the first resistance R4 and the second resistance R5.

The output of the operational amp 1 is fed back into the input terminals using the first resistance R4, the second resistance R5, and the third resistance R6, and is output as the output of the bandgap reference circuit. The output of the operational amp 1 is used as the reference voltage Vref.

The size of the transistor Q3 is different from that of the transistor Q4. The ratio of current flowing through the transistors Q3 and Q4 needs to be precisely adjusted. Accordingly, the transistor Q4 is often constructed by a plurality of transistors connected in parallel, having the same layout pattern as the transistor Q3.

The imaginary short of the operational amp 1 gives $$Vbe3=Vbe4+Vr4 \tag{1}$$

where Vbe3 is the forward voltage of the pn junction between the base and the emitter of the transistor Q3, Vbe4 is the forward voltage of the pn junction between the base and the emitter of the transistor Q4, and Vr4 is a voltage applied to the first resistance R4.

Vr4 is equal to the difference between Vbe3 and Vbe4, thus $$\Delta Vbe=Vbe3-Vbe4 \tag{2}$$

For each transistor Q3 and Q4, $$Vbe3=Vt*\ln(I3/Is3) \text{ and} \tag{3}$$

$$Vbe4=Vt*\ln(I4/Is4) \tag{4}$$

where Vt is the thermal voltage Vt=kT/q (k: Boltzmann constant, T: absolute temperature, and q: elementary electric charge). I3 is the current flowing through the third resistance R6 and the transistor Q3, and I4 is the current flowing through the second resistance R5, the first resistance R4, and the transistor Q4. Is3 and Is4 are the saturation currents of the transistors Q3 and Q4, respectively. For R5 and R6, the imaginary short of the operational amp 1 gives $$I4*R5=I3*R6 \tag{5}$$

Thus, $$I4=I3*R6/R5 \tag{6}$$

Substitution of (2), (3), and (4) gives $$\Delta Vbe=Vt*\ln((I3*Is4)/(I4*Is3)) \tag{7}$$

Combining (6) and (7), $$\Delta Vbe=Vt*\ln((R5*Is4)/(R6*Is3)) \tag{8}$$

The voltage of R5 is $$\Delta \mathrm{Vbe}*\mathrm{R5}/\mathrm{R4} \tag{9}$$

Because of the imaginary short of the operational amp 1, (9) plus Vbe3 is equal to Vref, $$Vref=\Delta Vbe*R5/R4+Vbe3 \tag{10}$$

Substitution of (10) and (8) gives $$Vref=(R5/R4)*Vt*\ln((R5*Is4)/(R6*Is3))+Vbe3 \tag{11}$$

In the case where the array of a plurality of bipolar transistors of exactly the same layout pattern as the transistor Q3 are used as the transistor Q4, the saturation current of Q4 is $$Is4=n*Is3 \tag{12}$$

Combining (11) and (12) gives $$Vref=(R5/R4)*Vt*\ln(n*R5/R6)+Vbe3 \tag{13}$$

The resistances R1, R2, and R3 and the number "n" of bipolar transistors are constants determinable by design. Setting K $$K=(R5/R4)\ln(n*R5/R6) \tag{14}$$

(13) becomes $$Vref=K*Vt+Vbe3 \tag{15}$$

As showed in (3), Vbe3 depends on both Vt and Is3. Since Vt=kT/q, Vt is a linear function of a temperature T of which inclination is k/q, 0.086 mV/° C. The saturation current Is3 of the bipolar transistor Q3 also depends on the temperature. The saturation current of a bipolar transistor generally depends on a temperature substantially linearly and its inclination is about −2 mV/° C. Accordingly, if K is set equal to about 23 (≅−Is/Vt), it is possible to substantially cancel the temperature dependency of Vref.

In practice, however, the temperature dependency of Vref disperses due to the dispersion in the forward-direction voltages Vbe of the bipolar transistors and in the resistances of the resistors, and due to the offset voltage of the operational amp.

Japanese Patent Laid-open Application No. 11-121694 discloses a technique to control the temperature dependency of a bandgap reference circuit by adjusting the resistance provided therein using a fuse.

However, there is a factor that degrades the temperature dependency inherent in the bandgap reference circuit. The factor is the temperature dependency of the resistances causing ΔVbe.

The temperature dependency of resistance of resistors provided in a large scale integrated circuit (LSI) in which a bandgap reference circuit is used is, in the case of a diffusion resistance using a diffusion layer, about 1000–1500 ppm/° C., and in the case of a poly silicon resistance of which sheet resistance is several dozens ohm, several hundreds ppm/° C. Accordingly, as for the resistance of the resistor generating ΔVbe, as the temperature rises, the load current flowing through the resistor is reduced. Even if the load current is reduced, the resistance ratio is not affected. However, the linear temperature dependency of Vbe is affected since the temperature dependency of the forward-direction voltage Vbe of the bipolar transistor depends on the load current.

FIG. 9 is a graph showing the actual data of temperature dependency of forward-direction voltage Vbe of a bipolar transistor. The y-axis indicates a forward-direction voltage Vbe (mV), and the x-axis indicates a temperature (° C.). The data are measured for the load current of 10 nA, 100 nA, and 1 μA. The data show that the negative inclination is gradually increased as the load current is increased in the order of 10 nA, 100 nA, and 1 μA.

FIG. 10 is a graph showing actual data of temperature dependency of Vt of a bipolar transistor. The y-axis indicates Vt (mV), and the x-axis indicates a temperature (° C.). The measurement was taken for the load currents of 10 nA, 100 nA, and 1 μA. Vt shows a temperature dependency as obtained in theory and does not depend on the load current as the load current dependency is cancelled when Vt is calculated by subtracting the forward direction voltages Vbe.

If the load currents I3 and I4 do not depend on temperature, the forward direction voltages Vbe3 and Vbe4 linearly depend on the temperature. As showed in FIG. 9, however, the load currents I3 and I4 depend on the temperature due to the temperature dependency of the resistances R4, R5, and R6. Accordingly, the linearity in the temperature dependency of the forward direction voltage Vbe3 and Vbe4 is disturbed.

To the contrary, as showed in FIG. 10, the temperature dependency of Vt does not depend on the load current. Accordingly, as expressed by (15), $$Vref=K*Vt+Vbe3$$

becomes dependent on the temperature.

DISCLOSURE OF THE INVENTION

Accordingly, it is an object of the present invention to provide a novel and useful circuit for generating a reference voltage in which one of the above problems is eliminated.

Another and more specific object of the present invention is to provide a circuit for generating a reference voltage that is provided with a bandgap reference circuit with a low temperature dependency.

According to the first aspect of the present invention, a circuit for generating a reference voltage may include a first diode, a second diode, an operational amp, a first resistance, and a second resistance, said first resistance and said second resistance being provided between said second diode and an output of said operational amp in series, and a third resistance provided between said first diode and said output of said operational amp, wherein a second voltage at a connection point between said first resistance and said second resistance is input to a first input terminal of said operational amp, a first voltage at a connection point between said first diode and said third resistance is input to a second input terminal of said operational amp, and temperature dependencies of said first resistance, said second resistance, and said third resistance are controlled so that temperature dependency of a load current flowing through said first resistance is eliminated.

It is possible to prevent the linearity of temperature dependency of the forward direction voltages Vbe of the first diode and the second diode from degrading by eliminating the temperature dependency of load current flowing through the first resistance. Accordingly, the temperature dependency of output from the bandgap reference circuit is reduced, and a circuit for generating a reference voltage with low temperature dependency can be provided.

In this description, a diode may include a bipolar transistor of which collector and base are mutually and electrically connected (used as a diode), and a pn junction diode, but is not limited to the above.

The circuit according to the first aspect may be characterized in that each of said first resistance, said second resistance, and said third resistance has a substantially same temperature dependency as the temperature dependency of a voltage applied between both ends of said first resistance.

According to the second aspect of the present invention, a circuit for generating a reference voltage may include a first diode, a second diode, an operational amp, a first resistance, and a second resistance, said first resistance and said second resistance being provided between said second diode and an output of said operational amp in series, and a third resistance provided between said first diode and said output of said operational amp, wherein a second voltage at a connection point between said first resistance and said second resistance is input to a first input terminal of said operational amp, a first voltage at a connection point between said first diode and said third resistance is input to a second input terminal of said operational amp, and temperature dependencies of said first resistance, said second resistance, and said third resistance are controlled so that linearity of temperature dependency of forward direction voltage Vbe of said first diode and said second diode is improved.

In the case where a bipolar transistor is used as a diode, for example, the temperature dependency of forward direction voltage Vbe of a base-emitter pn junction of the bipolar transistor has a negative temperature inclination and is determined by Vt and the saturation current Is. The temperature dependency of the saturation current Is is determined by the temperature dependency of the mobility μ and intrinsic carrier density ni, and the temperature dependencies thereof are functions of the powers of temperature T. Consequently, the temperature dependency of the forward direction voltage Vbe indicates a relatively convex curve. In the case of a pn junction diode, the same phenomenon as above appears. Accordingly, the output voltage of the bandgap reference circuit depends on temperature due to the non-linearity of temperature dependency of the forward direction voltage of the first diode and the second diode.

Since the circuit according to the second aspect of the present invention improves the linearity of temperature dependency of the forward direction voltage Vbe of said first diode and said second diode, the temperature dependency of output from the bandgap reference circuit is reduced, and a circuit for generating a reference voltage with a low temperature dependency is provided.

The forward direction voltages Vbe of a bipolar transistor used as a diode, as well as a pn junction diode, increases as its load current increases.

The circuit according to the second aspect of the present invention may be characterized in that said temperature dependency of each of said first resistance, said second resistance, and said third resistance is controlled so that a temperature dependency of a load current flowing through said first resistance has a positive temperature inclination.

The circuit according to the second aspect of the present invention may be characterized in that said temperature dependency of each of said first resistance, said second resistance, and said third resistance is smaller than the temperature dependency of a voltage applied between both ends of said first resistance.

The first resistance, the second resistance, and the third resistance provided in the circuit according to the first and second aspects of the present invention may include poly silicon resistances and metal film resistances including chromium (Cr), for example. The above resistances may further include MOS transistors of which resistances are determined by on-state resistances thereof. In addition, it is preferred that the MOS transistors be depletion type.

A power supply apparatus according to the present invention includes a plurality of divisional resistances that divide a sensed voltage, a reference voltage source that provides a reference voltage, and a comparator circuit that compares the divided sensed voltage and the reference voltage, wherein said reference voltage source is the circuit for generating a reference voltage according to the present invention.

Since the temperature dependency of the output provided by the circuit for generating a reference voltage is reduced, the temperature dependency of the output of the power supply apparatus is reduced. The stability of the power supply apparatus is consequently improved.

According to the fourth aspect of the present invention, a method of fabricating the circuit according to the first aspect includes the step of adjusting temperature dependencies of said first resistance, said second resistance, and said third resistance, each made of a poly silicon film, by adjusting sheet resistivities of the poly silicon films by controlling the amount of impurity to be doped in the poly silicon films so that temperature dependency of current flowing through said first resistance is eliminated.

The temperature dependency of the poly silicon resistance is controllable by the sheet resistivity. If the temperature dependency of the poly silicon resistance is adjusted so that the temperature dependency of load current flowing through the first resistance is eliminated, the circuit for generating a reference voltage according to the first aspect is obtainable.

The temperature dependencies of the poly silicon films may be adjusted to be substantially equal to the temperature dependency of a voltage between both ends of said first resistance.

According to the fifth aspect of the present invention, a method of fabricating the circuit of the first aspect, includes the step of adjusting temperature dependencies of said first resistance, said second resistance, and said third resistance, each made of a poly silicon film, by controlling sheet resistivities of the poly silicon films so that linearity of temperature dependency of forward direction voltages Vbe of said first diode and said second diode is improved.

The temperature dependency of the poly silicon resistance is controllable by the sheet resistivity. If the temperature dependency of the poly silicon resistance is adjusted so that the linearity of temperature dependency of the forward direction voltage Vbe of said first diode and said second diode, the circuit for generating a reference voltage according to the second aspect of the present invention is obtainable.

The temperature dependencies of the poly silicon films may be adjusted so that the temperature dependency of load current flowing through said first resistance has a positive temperature inclination.

The temperature dependencies of the poly silicon films may further be adjusted so that the temperature inclination thereof is smaller than the temperature inclination of a temperature dependency of a voltage ΔVbe between both ends of said first resistance.

According to the sixth aspect of the present invention, a method of fabricating a circuit according to the first aspect includes the step of adjusting on-state resistances of said first resistance, said second resistance, and said third resistance, each made of a MOS transistor, by controlling thresholds thereof so that a temperature dependency of load current flowing through said first resistance is eliminated.

The temperature dependency of the on-state resistance of a MOS transistor is controllable by dopant thresholds of the MOS transistor. If the temperature dependency of the on-state resistance of the MOS transistor is adjusted so that the temperature dependency of a load current flowing through the first resistance is eliminated, the circuit for generating a reference voltage according to the first aspect is obtained.

In the case of the above third aspect, the on-state resistances may be adjusted so that the temperature dependency thereof is substantially equal to the temperature dependency of a voltage ΔVbe applied to both ends of said first resistance.

According to the seventh aspect of the present invention, a method of fabricating a circuit of the second aspect includes the step of adjusting on-state resistances of said first resistance, said second resistance, and said third resistance, each made of a MOS transistor, by controlling dopant thresholds thereof so that the linearity of the temperature dependency of forward direction voltage of said first diode and said second diode is improved.

The temperature dependency of the on-state resistance of the MOS transistor can be controlled by its dopant threshold. If the temperature dependency of the on-state resistance of the MOS transistor is adjusted so that the linearity of temperature dependency of the forward direction voltage Vbe of the first diode and the second diode is improved, the circuit for generating a reference voltage of the second aspect is obtainable.

In the case of the above aspect, the temperature dependencies of the MOS transistors may be adjusted so that the temperature dependency of a load current flowing through said first resistance has a positive inclination.

The temperature dependencies of the MOS transistors may further be adjusted so that a temperature inclination thereof is smaller than a temperature inclination of a temperature dependency of a voltage between both ends of said first resistance.

Other objects, features, and advantages of the present invention will become more apparent from the following detailed description when read in conjunction with the accompanying drawings.

BEST MODE FOR IMPLEMENTING THE INVENTION

A detailed description of preferred embodiments will be given below by reference to the drawings.

[First Embodiment]

Figure 1:
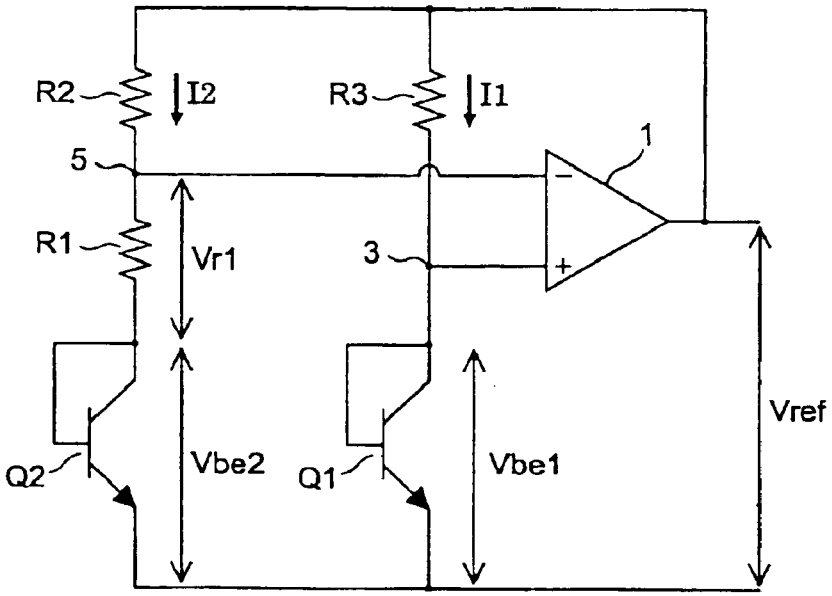
FIG. 1 is a circuit diagram showing a circuit for generating a reference voltage according to an embodiment of the present invention.

FIG. 1 is a circuit diagram showing a circuit for generating a reference voltage according to an embodiment of the present invention.

In the circuit of FIG. 1, a third resistance R3 and an npn bipolar transistor (a first diode) Q1 are provided in series between the output terminal of the operational amp 1 and the ground potential. The transistor Q1 is used as a diode by connecting the collector and the base thereof. The forward direction voltage of the pn junction between the base and the emitter is indicated as Vbe1.

A second resistance R2, a first resistance R1, and an npn bipolar transistor (second diode) Q2 are provided between the output terminal of the operational amp 1 and the ground potential in series. The collector and the base of the transistor Q2 are connected to each other, so that the transistor Q2 functions as a diode. The forward direction voltage of the base-emitter pn junction is indicated as Vbe2.

The transistors Q1 and Q2 are different in size. Since the ratio of currents flowing through is required to be precisely adjusted, the transistor Q2 is often configured by an array of a plurality of bipolar transistors each having the same layout pattern as the transistor Q1.

The resistances of the first, second, and third resistors are indicated by R1, R2, and R3. The load current flowing through the first resistance R1 and the second resistance R2 is indicated as I2, and the load current flowing through the third resistance R3 is indicated as I1. The voltage applied between the two ends of the first resistance R1 is indicated as Vr1.

A first voltage at a connection point 3 between the third resistance R3 and the transistor Q1 is input to a non-inverted input terminal (+) of the operational amp 1. A second voltage at a connection point 5 between the first resistance R1 and the second resistance R2 is input to a inverted input terminal (−). The output of the operational amp 1 fed back with the first, second, and third resistances R1, R2, and R3 is the reference voltage Vref.

In this circuit, the temperature dependency of the load current I2 flowing through the first and second resistances R1 and R2 is $$\delta I2/\delta T=0 \tag{16}$$

Therefore, $$I2=\Delta Vbe/R1 \tag{17}$$

where ΔVbe is the voltage VR1 applied to the two ends of the first resistance R1.

The temperature dependency of the load current I2 is eliminated if the first, second, and third resistances R1, R2, and R3 have the same temperature dependency as that of ΔVbe.

In the case where the transistor Q2 is configured by an array of "n" bipolar transistors having the exactly same layout pattern as a bipolar transistor used as the transistor Q1, the array being connected in series, the temperature dependency of ΔVbe is $$\Delta Vbe=\ln(n)*kT/q \tag{18}$$

where k is Boltzmann constant and q is the elementary electric charge.

Differentiation of (18) gives $$\delta\Delta Vbe/\delta T=\ln(n)*k/q \tag{19}$$

Assuming ΔVbe being 54 mV, its temperature dependency δΔVbe/δT being 0.177 mV/° C., the temperature dependency of the first resistance R1 is desired to be 3300 ppm/° C. (≅0.177/54) so as to eliminate the temperature dependency of the load current I2.

If the temperature dependency of the load current I2 is eliminated, the forward direction voltages Vbe1 and Vbe2 of the transistors Q1 and Q2, respectively, are not affected by the change of the load currents I1 and I2 caused by temperature. Accordingly, it is possible to avoid degrading of the linearity of the temperature dependency of the forward direction current Vbe1 and Vbe2. It is possible to reduce the temperature dependency of the output of the bandgap reference circuit and provide a circuit for generating a reference voltage of which reference voltage Vref is little dependent on the temperature.

Figure 2:
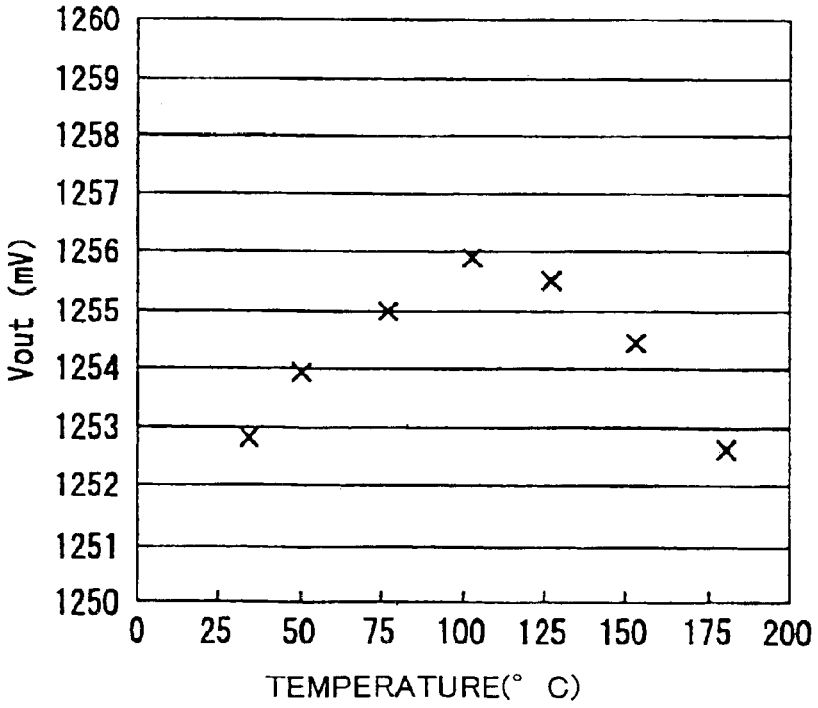
FIG. 2 is a graph showing the temperature dependency of the circuit for generating a reference voltage according to the embodiment.

FIG. 2 is a graph showing the temperature dependency of the circuit for generating a reference voltage according the first embodiment. The y-axis indicates an output voltage Vout (mV) as the reference voltage Vref, and the x-axis indicates a temperature (° C.).

FIG. 2 shows that the circuit for generating a reference voltage according to the first embodiment exhibits preferable temperature dependency of which maximum is about 30 ppm/° C.

[Second Embodiment]

The temperature dependency of the circuit for generating a reference voltage according to the first embodiment is, as showed in FIG. 2, convex in its entirety. Even though the linearity of the forward direction voltage Vbe1 and Vbe2 of the transistors Q1 and Q2, respectively, is improved by eliminating the temperature dependency of the load current I2, the temperature dependency of the circuit is convex because the temperature dependency of the forward direction voltage Vbe bipolar transistors is, to be accurate, not linear.

The temperature dependency of the reference voltage Vref of the circuit for generating a reference voltage is further reduced by, instead of eliminating the temperature dependency of the load current as in the first embodiment, controlling the temperature dependency of the load current so that the linearity of temperature dependency of the forward direction voltage Vbe of bipolar transistors is improved.

In the case of the first embodiment, the temperature dependency $\delta\Delta Vbe/\delta T$ can be relatively easily eliminated since the temperature dependency of the reference voltage Vref is reduced by controlling the temperature dependency $\delta\Delta Vbe/\delta T$ that is a constant as showed in (19).

In the case of the second embodiment, however, it is necessary to strictly control the temperature dependency of the forward direction voltage Vbe of bipolar transistors. Though the strict control of the temperature dependency of the forward direction voltage Vbe of bipolar transistors is difficult due to the change in the load current, the strict control is beneficial in providing a bandgap reference circuit (a circuit for generating a reference voltage) having even low temperature dependency.

Figure 9:
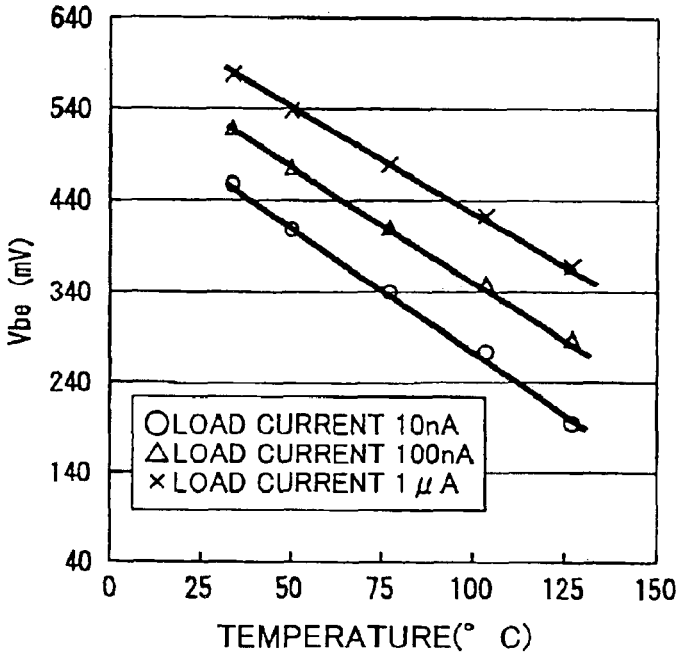
FIG. 9 is a graph showing the temperature dependency of the forward direction voltage Vbe of a bipolar transistor.
Figure 10:
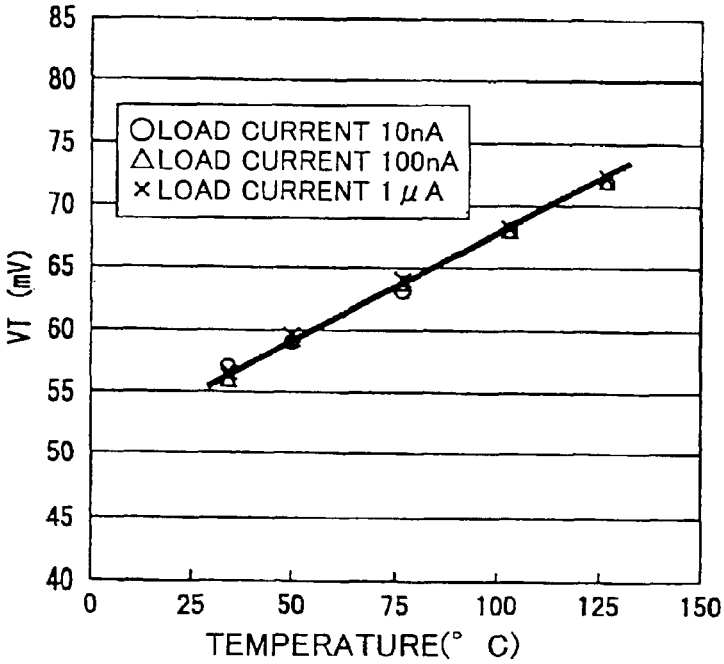
FIG. 10 is a graph showing the temperature dependency of Vt of a bipolar transistor.

As showed in FIG. 9, as the load current increases, the forward direction voltage Vbe also increases. The linearity of the temperature dependency of the forward direction voltage Vbe is improved by controlling the load current to increase as temperature rises.

Assuming the same condition as the first embodiment, that is, $\Delta Vbe$ being 54 mV and the temperature dependency $\delta\Delta Vbe/\delta T$ being 0.177 mV/° C., the temperature dependency of $\Delta Vbe$ is 3300 ppm/° C. ($\cong$0.177/54). In the case of the second embodiment, the load current is increased as the temperature increases by controlling the temperature dependency of the first, second, and third resistances R1, R2, and R3, respectively, lower than that of $\Delta Vbe$.

When the load current (base-emitter current) Ibe=10 nA, for example, the load current may increase about 30% when temperature increases by 100° C., which is an inclination of 3000 ppm/° C. Accordingly, as will be described later, the load currents I1 and I2 increase as the temperature rises by using first, second, and third resistances having temperature dependency of substantially 0 ppm/° C., that is, no temperature dependency. Accordingly, the linearity of the forward direction voltages Vbe1 and Vbe2 is improved. The temperature dependency of the reference voltage Vref output by the bandgap reference circuit is further reduced.

In the case where poly-silicon resistors are used as the first, second, and third resistances R1, R2, and R3 in the first and second embodiments, the temperature dependency of the first, second, and third resistances can be controlled by controlling the impurity (dopant) density introduced into a poly-silicon layer forming the poly-silicon resistance to control its sheet resistivity.

Figure 3:
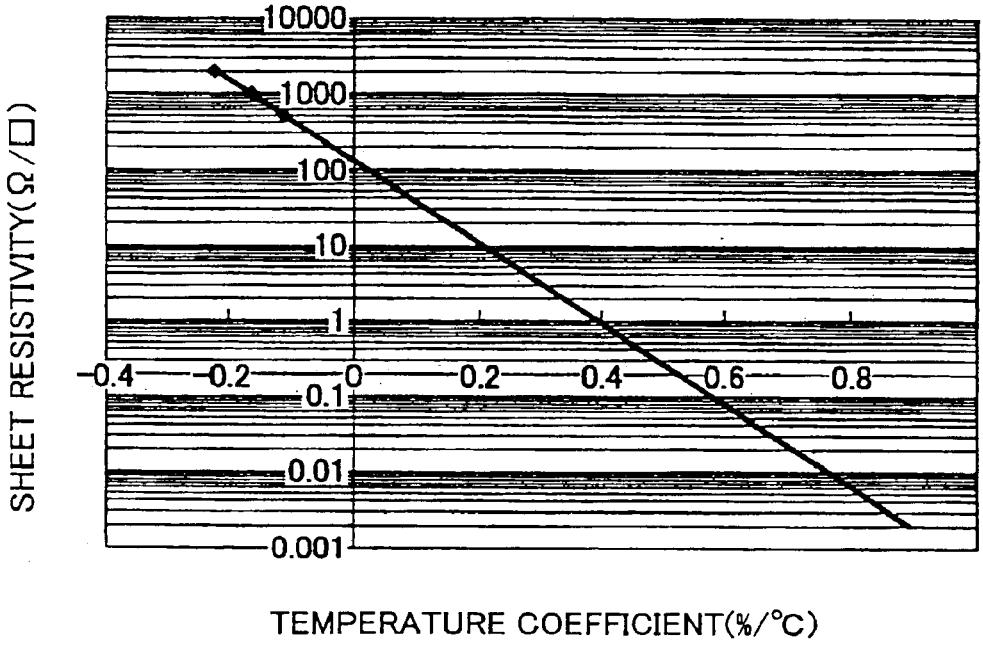
FIG. 3 is a graph showing the relationship between a temperature coefficient and a sheet resistivity of a poly silicon resistance.

FIG. 3 is a graph showing the relationship between temperature coefficient and sheet resistivity of a poly-silicon resistance. The x-axis indicates the temperature coefficient (%/° C.), and the y-axis indicates a sheet resistivity (Ω/□). The resistances of poly silicon resistors, consisting of a poly silicon film each being 100 μm long, 2.0 μm wide, and 0.35 μm thick, of which sheet resistivities are 500 Ω/□, 1000 Ω/□, and 2000 Ω/□ were measured at 25° C., 55° C., and 85° C., respectively. Using the resistance at 25° C., the temperature coefficient corresponding to each sheet resistivity is calculated using linear regression of the following formula:

$$\text{Resistance } R \text{ at a temperature } T\ ^\circ\text{C.}=(1+Tc*(T-25))*R(0) \qquad (20)$$

where Tc is the temperature coefficient, and R(0) is the sheet resistivity at a temperature 25° C.

FIG. 3 shows that the temperature coefficient of sheet resistivities 500 Ω/□, 1000 Ω/□, 2000 Ω/□ are negative.

If a poly silicon resistance of 3300 ppm/° C. is desired, for example, the impurity density of the poly silicon film needs to be controlled so that the sheet resistivity thereof becomes about 2 Ω/□. In this case, if 2 Ω/□ is difficult to reach with existing processes, a polycide of a high melting point metal such as tungsten and titan may be applied.

If the sheet resistivity is set at about 120 Ω/□, the temperature coefficient is zero, and a poly silicon resistance having no temperature dependency can be formed.

In the case where the first, second, and third resistances are formed by metal film including Cr, for example, the temperature dependency of the resistors can be modified by controlling the composition. If NiCr (nickel chromium) or SiCr (silicon chromium) is used, for example, the temperature dependency is controllable by changing the amount of chromium.

[Third Embodiment]

The resistors in the above first and second embodiments are made of poly silicon. The resistors may be replaced by the on-state resistances of MOS transistors. In this case, the on-state resistance of a MOS transistor can be set at a desired value by adjusting the amount of dopant to be doped in the channel of the MOS transistor. The on-state resistance of a MOS transistor is precisely adjustable because it is determined by the size of the MOS transistor. In addition, since the resistors are manufactured in the manufacturing process of MOS transistors, the circuit can be manufactured at a relatively low cost.

Figure 4:
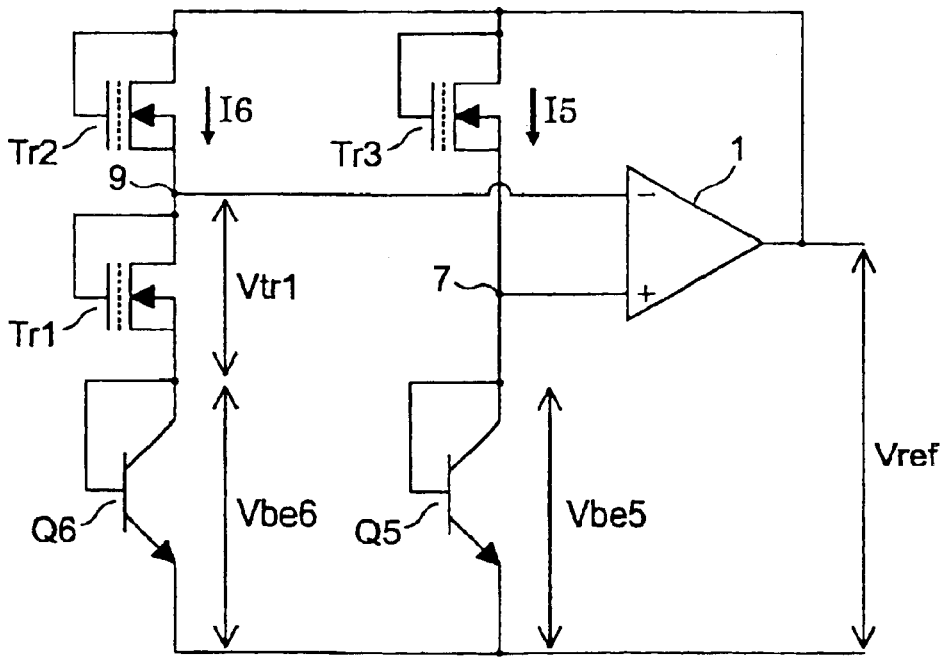
FIG. 4 is a circuit diagram showing a circuit for generating a reference voltage according to another embodiment of the present invention.

FIG. 4 is a circuit diagram showing a circuit for generating a reference voltage according to another embodiment of the present invention.

The circuit of FIG. 4 is provided with a depletion type n-channel MOS transistor Tr3 and an npn bipolar transistor (the first diode) Q5 connected in series between the output terminal of an operational amp 1 and the ground potential. The MOS transistor Tr3 of which gate and drain are mutually electrically connected constructs the third resistance of the circuit for generating a reference voltage according to the embodiment. The transistor Q5 of which collector and base are mutually electrically connected is connected as a diode. The forward direction voltage of the base-emitter pn junction of the transistor Q5 is indicated as Vbe5.

Two depletion type n-channel MOS transistor Tr2 and Tr1 and an npn bipolar transistor (the second diode) Q6 are provided in series between the output terminal of the operational amp 1 and the ground potential. The MOS transistors Tr1 and Tr2 of which gate electrode and drain are electrically connected construct the first resistance and the second resistance, respectively. The transistor Q6 of which collector and base are mutually electrically connected is connected as a diode. The forward direction voltage of the base-emitter pn junction of the transistor Q6 is indicated as Vbe6.

The transistors Q5 and Q6 are different in size. The transistor Q6 may be constructed by a plurality of bipolar transistors arrayed in parallel, each bipolar transistor having exactly the same layout pattern as the transistor Q5.

The resistances of the MOS transistors Tr1, Tr2, and Tr3 are indicated as Tr1, Tr2, and Tr3, respectively. The load current flowing through the MOS transistors Tr1 and Tr2 is indicated as I6, and the load current flowing through the MOS transistor Tr3 is indicated as I5. The voltage between the two ends of the MOS transistor Tr1 is indicated as Vtr1.

The first voltage at the connection point 7 between the MOS transistor Tr3 and the transistor Q5 is input to the non-inverted input terminal (+) of the operational amp 1. The second voltage at the connection point 9 between the MOS transistor Tr1 and the MOS transistor Tr2 is input to the inverted input terminal (−) of the operational amp 1. The output of the operational amp 1 fed by the MOS transistors Tr1, Tr2, and Tr3 is the reference voltage Vref.

The temperature dependency of the load current I6 is eliminated by controlling the on-state resistance of the MOS transistors Tr1, Tr2, and Tr3 in the same manner as in the first embodiment, in which the temperature dependency of the load current I2 is eliminated by controlling the first, second, and third resistances. A detailed description will be given later.

Accordingly, the forward direction voltages Vbe5 and Vbe6 of the transistors Q5 and Q6, respectively, are not affected by the temperature dependency of the load current I5 and I6, and the linearity of the temperature dependency of the forward direction voltage Vbe5 and Vbe6 is not degraded. The temperature dependency of the output of the bandgap reference circuit is consequently lowered. It is possible to provide a circuit for generating a reference voltage that is less dependent on temperature.

The linearity of temperature dependency of the forward direction voltages Vbe5 and Vbe6 is improved by controlling the temperature dependency of on-state resistances of the MOS transistors Tr1, Tr2, and Tr3 in the same manner as in the second embodiment, in which the linearity of temperature dependency of the forward direction voltages Vbe1 and Vbe2 is improved by controlling the temperature dependencies of the first, second, and third resistances. Accordingly, the temperature dependency of the reference voltage Vref output by the bandgap reference circuit is reduced.

The temperature dependency of the on-state resistance of a MOS transistor is determined by the temperature dependencies of a threshold Vth and mobility $\mu$. The threshold Vth has a negative inclination for an increasing temperature. If a gate voltage is constant, the on-state resistance is reduced as the temperature increases. The mobility $\mu$ has a negative inclination for an increasing temperature. The on-state resistance increases as the temperature increases. Since the threshold Vth and the mobility $\mu$ have opposite temperature dependencies, the temperature dependency of the on-state resistance can be adjusted freely from a negative value to a positive value.

Accordingly, it is possible to control the temperature dependencies of on-state resistances of the MOS transistors Tr1, Tr2, and Tr3 by controlling the amount of dopant to be introduced in a channel and consequently adjusting the thresholds of the MOS transistors Tr1, Tr2, and Tr3 in the fabricating process of the MOS transistors.

Figure 5:
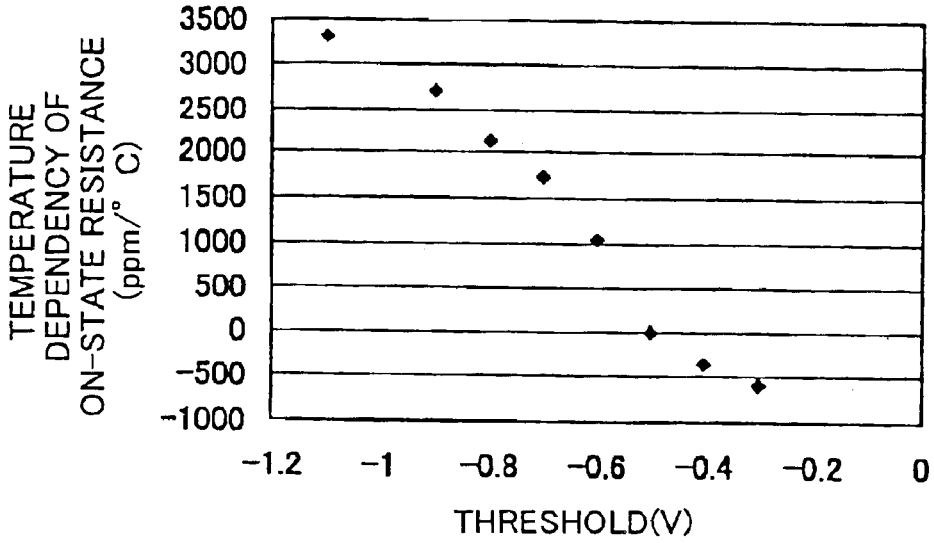
FIG. 5 is a graph showing the relationship between a temperature dependency and a threshold of the on-state resistance of a depletion-type n-channel MOS transistor.

FIG. 5 is a graph showing the relationship between the temperature dependency (ppm/° C.) and the threshold (V) of a depletion type n-channel MOS transistor. In the measurement, depletion type n-channel MOS transistors each having a 10 $\mu$m wide and 5 $\mu$m long channel were used. The drain-source voltage was set at 60 mV (substantially equal to the above ΔVbe), and on-state resistances at which the gate-source voltage is 0V were measured.

FIG. 5 shows that the temperature dependency of the on-state resistance changes as the threshold changes. Accordingly, it is possible to control the temperature dependency of the on-state resistance of a depletion type n-channel MOS transistor.

In the above embodiments, the transistors Q1 and Q5, that is, the first diode, each consists of a single bipolar transistor, and the transistors Q2 and Q6, that is, the second diode, each consists of a plurality of bipolar transistors connected in an array in parallel, each having exactly the same layout pattern as the transistors Q1 and Q5.

The present invention is not limited to this configuration. The first diode and the second diode may be constructed in accordance with any other configuration as long as the ratio of load currents flowing through the first diode and the second diode is precisely adjustable.

In the above embodiments, the first, second, and third resistances are constructed by poly silicon resistors, metal film resisters including chromium, and MOS transistors. The present invention is not limited to these resistors, and any other resistors having an appropriate temperature dependency are applicable.

The bipolar transistors each connected as a diode are used as the first diode and the second diode in the above embodiments; however, the present invention is not limited to these bipolar transistors. The first diode and the second diode may be constructed by pn junction diodes.

[Fourth Embodiment]

Figure 6:
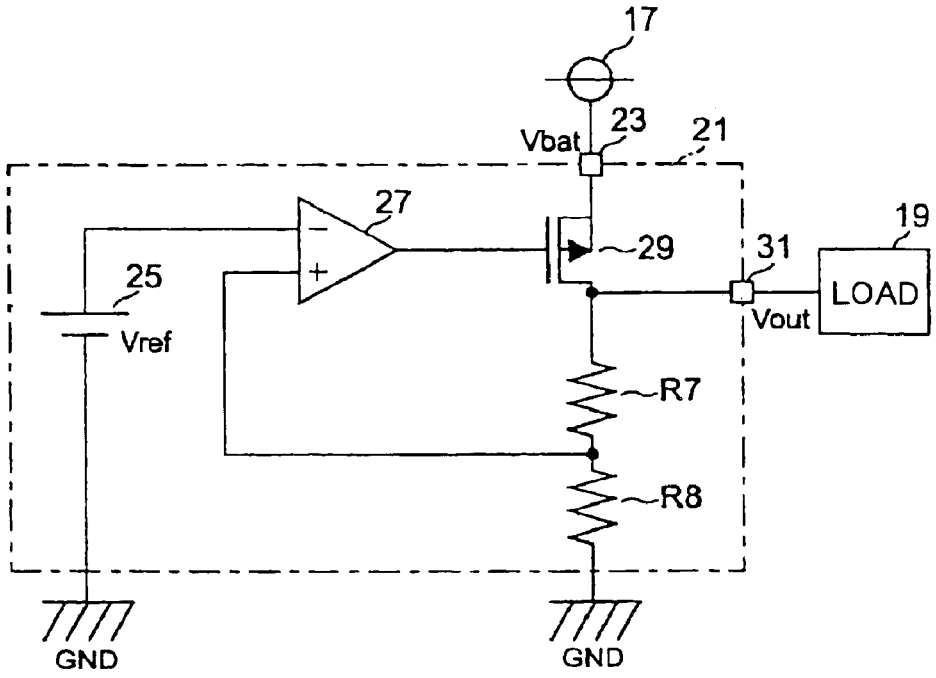
FIG. 6 is a circuit diagram showing a power supply apparatus according to an embodiment of the present invention.

FIG. 6 is a circuit diagram showing a power supply apparatus in which a circuit for generating a reference voltage according to the present invention is provided.

A constant voltage generation circuit 21 regulates power provided by a direct current power supply 17 and supplies the regulated power to a load 19. The constant voltage generation circuit 21 is provided with the following: an input terminal (Vbat) 23 to which the direct current power supply 17 is connected, a reference voltage generation circuit 25 for generating a reference voltage (Vref) as a reference voltage source, an operational amp 27, a p-channel MOS transistor 29 (hereinafter referred to as PMOS) that constructs an output driver, divisional resistances R7 and R8, and an output terminal (Vout) 31.

The output terminal of the operational amp 27 is connected to the gate electrode of PMOS 29. The reference voltage Vref provided by the reference voltage generation circuit 25 is input to the inverted input terminal of the operational amp 27, and a voltage obtained by dividing the output voltage Vout with the divisional resistances R7 and R8 is input to the non-inverted input terminal of the operational amp 27. The voltage obtained by dividing the output voltage Vout is controlled so that it becomes equal to the reference voltage Vref.

The circuit for generating a reference voltage according to the present invention is used in the constant voltage generation circuit 21 as the reference voltage generation circuit 25. Since the temperature dependency of output of the bandgap reference circuit provided in the reference voltage generation circuit 25 is reduced so as to reduce the temperature dependency of the reference voltage Vref, it is possible to improve the stability of the output of the constant voltage generation circuit 21.

[Fifth Embodiment]

Figure 7:
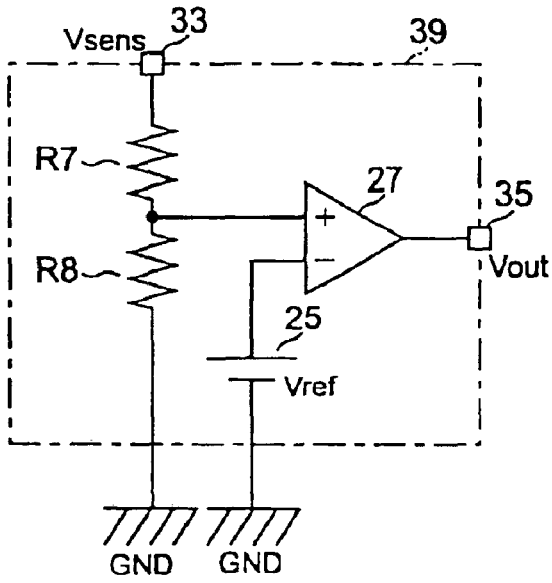
FIG. 7 is a circuit diagram showing a power supply apparatus according to another embodiment of the present invention.
Figure 8:
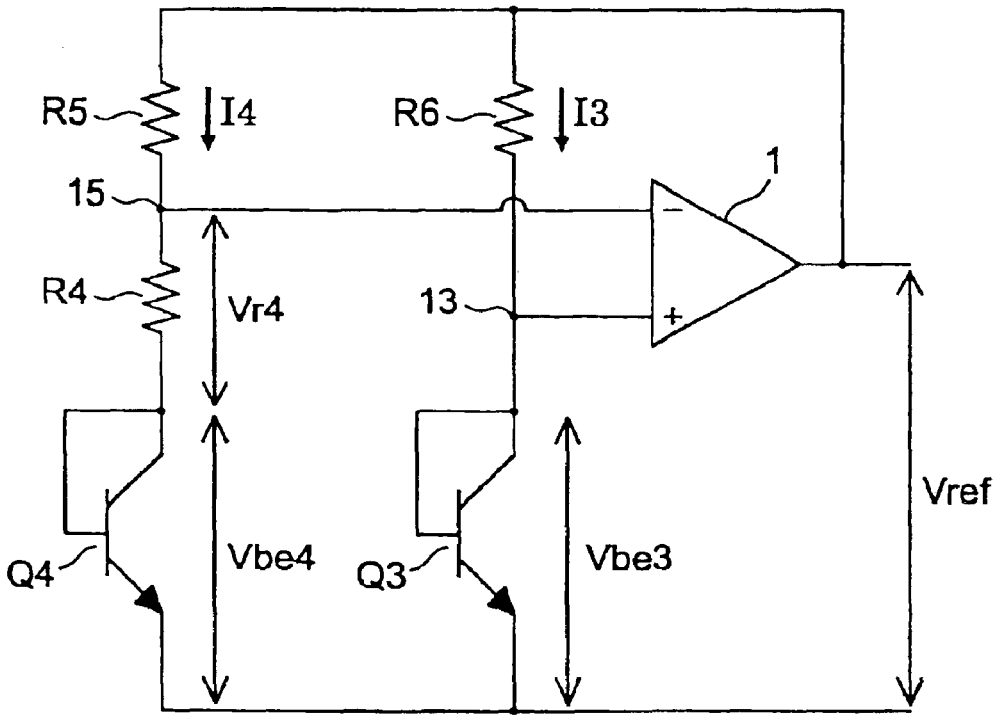
FIG. 8 is a circuit diagram showing a conventional circuit for generating a reference voltage.

FIG. 7 is a circuit diagram showing a voltage detection apparatus provided with a circuit for generating a reference voltage according to the present invention.

The reference voltage generation circuit 25 is connected to the inverted input terminal of an operational amp 27 so as to apply the reference voltage Vref. A voltage to be measured is input through an input terminal Vsens 33 and divided by divisional resistances R7 and R8. The divided voltage is input to the non-inverted input terminal of the operational amp 27. The output of the operational amp 27 is output through an output terminal (Vout) 35.

When the voltage Vsens to be measured is high, and the voltage divided by the divisional resistances R7 and R8 is higher than the reference voltage Vref, the output of the operational amp 27 remains at a high level. As the voltage Vsens to be measured decreases, and when the voltage divided by the divisional resistances R7 and R8 becomes lower than the reference voltage Vref, the output of the operational amp 27 becomes low.

The circuit for generating a reference voltage according to the present invention is used as the reference voltage generation circuit 25 in the voltage detection circuit 39. Since the temperature dependency of output of the bandgap reference circuit constructing the circuit for generating a reference voltage is reduced, and the temperature dependency of the reference circuit Vref is consequently reduced, the stability of output of the voltage detection circuit 39 is improved.

The preferred embodiments of the present invention are described above. The present invention is not limited to these embodiments, but various variations and modifications may be made without departing from the scope of the present invention.

This patent application is based on Japanese Laid-open Patent Application No. 2002-051223 filed on Feb. 27, 2002, the entire contents of which are hereby incorporated by reference.

INDUSTRIAL APPLICABILITY

A circuit for generating a reference voltage according to the present invention includes a first diode, a second diode, an operational amp, a first resistance and a second resistance, said first resistance and said second resistance being provided between said second diode and an output of said operational amp in series, and a third resistance provided between said first diode and said output of said operational amp. A second voltage at a connection point between said first resistance and said second resistance is input to a first input terminal of said operational amp, and a first voltage at a connection point between said first diode and said third resistance is input to a second input terminal of said operational amp.

Since temperature dependencies of said first resistance, said second resistance, and said third resistance are controlled so that the temperature dependency of a load current flowing through said first resistance is eliminated, it is possible to prevent the linearity of temperature dependency of the forward direction voltages Vbe of the first diode and the second diode from degrading. Accordingly, the temperature dependency of output from the bandgap reference circuit is reduced, and a circuit for generating a reference voltage with low temperature dependency can be provided.

On the other hand, temperature dependencies of said first resistance, said second resistance, and said third resistance may be controlled so that the linearity of the temperature dependency of forward direction voltage Vbe of said first diode and said second diode is improved.

Since the circuit according to the present invention improves the linearity of the temperature dependency of forward direction voltage Vbe of said first diode and said second diode, the temperature dependency of output from the bandgap reference circuit is reduced, and a circuit for generating a reference voltage with a low temperature dependency is provided.

What is claimed is:

1. A circuit for generating a reference voltage, comprising:

a first diode;

a second diode;

an operational amp;

a first resistance;

a second resistance, said first resistance and said second resistance being provided between said second diode and an output of said operational amp in series; and a third resistance provided between said first diode and said output of said operational amp;

wherein a second voltage at a connection point between said first resistance and said second resistance is input to a first input terminal of said operational amp;

a first voltage at a connection point between said first diode and said third resistance is input to a second input terminal of said operational amp; and temperature dependencies of said first resistance, said second resistance, and said third resistance are controlled so that the temperature dependency of a load current flowing through said first resistance is eliminated.

2. The circuit as claimed in claim 1, wherein each of said first resistance, said second resistance, and said third resistance has a substantially same temperature dependency as the temperature dependency of a voltage applied between the two ends of said first resistance.

3. The circuit as claimed in claim 1, wherein said first resistance, said second resistance, and said third resistance are poly silicon resistances.

4. The circuit as claimed in claim 1, wherein said first resistance, said second resistance, and said third resistance are metal film resistances including chromium.

5. The circuit as claimed in claim 1, wherein each of said first resistance, said second resistance, and said third resistance is made of a MOS transistor of which an on-state resistance determines the resistance thereof.

6. The circuit as claimed in claim 5, wherein said MOS transistor is a depletion type.

7. A method of fabricating a circuit as claimed in claim 1, comprising the step of adjusting temperature dependencies of said first resistance, said second resistance, and said third resistance, each made of a poly silicon film, by controlling sheet resistivities of the poly silicon films so that the temperature dependency of a current flowing through said first resistance is eliminated.

8. The method as claimed in claim 7, wherein said temperature dependencies of the poly silicon films are adjusted to be substantially equal to the temperature dependency of a voltage between the two ends of said first resistance.

9. A method of fabricating a circuit as claimed in claim 1, comprising the step of adjusting on-state resistances of said first resistance, said second resistance, and said third resistance, each made of a MOS transistor, by controlling thresholds thereof so that the temperature dependency of the load current flowing through said first resistance is eliminated.

10. The method as claimed in claim 9, wherein said on-state resistances are adjusted so that the temperature dependency thereof is substantially equal to the temperature dependency of a voltage applied to the two ends of said first resistance.

11. A circuit for generating a reference voltage, comprising:

a first diode;

a second diode;

an operational amp;

a first resistance;

a second resistance, said first resistance and said second resistance being provided between said second diode and an output of said operational amp in series; and a third resistance provided between said first diode and said output of said operational amp;

wherein a second voltage at a connection point between said first resistance and said second resistance is input to a first input terminal of said operational amp;

a first voltage at a connection point between said first diode and said third resistance is input to a second input terminal of said operational amp; and temperature dependencies of said first resistance, said second resistance, and said third resistance are controlled so that the linearity of the temperature dependency of a forward direction voltage of said first diode and said second diode is improved.

12. The circuit as claimed in claim 11, wherein said temperature dependency of each of said first resistance, said second resistance, and said third resistance is controlled so that the temperature dependency of a load current flowing through said first resistance has a positive temperature inclination.

13. The circuit as claimed in claim 12, wherein said temperature dependency of each of said first resistance, said second resistance, and said third resistance is less than the temperature dependency of a voltage applied between the two ends of said first resistance.

14. A method of fabricating a circuit as claimed in claim 11, comprising the step of adjusting temperature dependencies of said first resistance, said second resistance, and said third resistance, each made of a poly silicon film, by controlling sheet resistivities of the poly silicon films so that the linearity of the temperature dependency of the forward direction voltages of said first diode and said second diode is improved.

15. The method as claimed in claim 14, wherein said temperature dependencies of the poly silicon films are adjusted so that the temperature dependency of a load current flowing through said first resistance has a positive temperature inclination.

16. The method as claimed in claim 15, wherein said temperature dependencies of the poly silicon films are adjusted so that the temperature inclination thereof is less than the temperature inclination of the temperature dependency of a voltage between the two ends of said first resistance.

17. A method of fabricating a circuit as claimed in claim 11, comprising the step of adjusting on-state resistances of said first resistance, said second resistance, and said third resistance, each made of a MOS transistor, by controlling thresholds thereof so that the linearity of the temperature dependency of the forward direction voltage of said first diode and said second diode is improved.

18. The method as claimed in claim 17, wherein said temperature dependencies of the MOS transistors are adjusted so that the temperature dependency of a load current flowing through said first resistance has a positive temperature inclination.

19. The method as claimed in claim 18, wherein said temperature dependencies of the MOS transistors are adjusted so that the temperature inclination thereof is less than the temperature inclination of the temperature dependency of a voltage between the two ends of said first resistance.

20. A power supply apparatus, comprising:

a plurality of divisional resistances that divide a sensed voltage;

a reference voltage source that provides a reference voltage; and a comparator circuit that compares the divided sensed voltage and the reference voltage;

wherein said reference voltage source further comprises:

a first diode;

a second diode;

an operational amp;

a first resistance;

a second resistance, said first resistance and said second resistance being provided between said second diode and an output of said operational amp in series; and a third resistance provided between said first diode and said output of said operational amp;

wherein a second voltage at a connection point between said first resistance and said second resistance is input to a first input terminal of said operational amp;

a first voltage at a connection point between said first diode and said third resistance is input to a second input terminal of said operational amp; and temperature dependencies of said first resistance, said second resistance, and said third resistance are controlled so that the temperature dependency of a load current flowing through said first resistance is eliminated.

21. A power supply apparatus, comprising:

a plurality of divisional resistances that divide a sensed voltage;

a reference voltage source that provides a reference voltage; and a comparator circuit that compares the divided sensed voltage and the reference voltage;

wherein said reference voltage source further comprises:

a first diode;

a second diode;

an operational amp;

a first resistance;

a second resistance, said first resistance and said second resistance being provided between said second diode and an output of said operational amp in series; and a third resistance provided between said first diode and said output of said operational amp;

wherein a second voltage at a connection point between said first resistance and said second resistance is input to a first input terminal of said operational amp;

a first voltage at a connection point between said first diode and said third resistance is input to a second input terminal of said operational amp; and temperature dependencies of said first resistance, said second resistance, and said third resistance are controlled so that the linearity of the temperature dependency of a forward direction voltage of said first diode and said second diode is improved.

* * * * *